United States Patent [19]

Mende

[11] Patent Number: 4,826,415

[45] Date of Patent: May 2, 1989

[54] MELT BLOW DIE

[75] Inventor: Takayuki Mende, Itsukaiti, Japan

[73] Assignee: Mitsui Petrochemical Industries, Ltd., Tokyo, Japan

[21] Appl. No.: 110,787

[22] Filed: Oct. 21, 1987

[30] Foreign Application Priority Data

Oct. 21, 1986 [JP] Japan ..... 61-251319
Mar. 11, 1987 [JP] Japan ..... 62-57494

[51] Int. Cl.[4] ..... B29C 47/78

[52] U.S. Cl. ..... 425/722; 264/12; 425/7

[58] Field of Search ..... 264/12, 171, DIG. 75; 425/6, 7, 72.2

[56] References Cited

U.S. PATENT DOCUMENTS 3,825,379 7/1974 Lohkamp ..... 425/72.2

FOREIGN PATENT DOCUMENTS 159336 12/1981 Japan .
44470 3/1983 Japan .

*Primary Examiner*—Jay H. Woo
*Assistant Examiner*—Timothy W. Heitbrink
*Attorney, Agent, or Firm*—Sherman and Shalloway

[57] ABSTRACT

A melt blow die for use in a melt spinning apparatus includes a die block assembly having a chamber for receiving melt of a thermoplastic resin, at least one array of a plurality of capillary tubes arranged in a plane and having one ends held by the die block assembly, the capillary tube communicating with the chamber in the die block assembly, and gas plates connected to the die block assembly and defining therebetween gas chambers. The gas plates has lips which cooperate with each other to define a slit communicating with the gas chambers and to clamp the other ends of the array of capillary tubes in such a manner that gas orifices are formed between the peripheral surfaces of the capillary tubes and the adjacent surfaces of the lips. A gas introduced into the gas chambers is blown through the gas orifices to draw the melt of the thermoplastic resin extruded through the capillary tubes. The array of capillary tubes may be constructed as a unit which is detachably secured to the die block assembly.

8 Claims, 4 Drawing Sheets

MELT BLOW DIE

BACKGROUND OF THE INVENTION

The present invention relates to a melt blow die and, more particularly, to a melt blow die of the type having a plurality of capillary tubes through which melt of a thermoplastic resin is extruded and the extruded melt is drawn and spun into fine fibers by means of a gas which is blown through orifices formed around the capillary tubes onto the melt immediately after the extrusion.

Melt blow dies have been known as disclosed, for example, in Japanese Patent Publication No. 44470/1983 (based on U.S. Ser. No. 242,506) and Japanese Patent Laid-Open publication No. 159336/1981 (based on U.S. Ser. No. 138,860) More specifically, the melt blow die disclosed in Japanese Patent Publication No. 44470/1983 is constituted by a die tip having a triangular cross-section, at least one array of capillary tubes soldered to the die tip, and gas plates disposed above and below the die tip leaving suitable clearances constituting gas orifices. Disclosed also is a melt blow die in which one ends of the capillary tubes arranged in an array are rigidly held by a die block so that the capillary tubes are cantilevered, and a pair of gas plates are disposed above and below the the capillary tubes so as to define orifices. In operation, a gas is blown onto fibers in molten state immediately after the extrusion at a predetermined angle with respect to the extruded fibers, through the gas orifices which are formed between the gas plates and the die tip or between the gas plates and the free ends of the capillary tubes.

On the other hand, Japanese Patent Laid-Open Publication No. 159336/1981 discloses a melt blow die in which a plurality of capillary tubes arranged in the form of a matrix are inserted into tiny holes of a screen mesh such that the ends of the capillary tubes project through the screen mesh, and the spaces around the capillary tube are utilized as gas orifices through which a gas is blown so as to draw the melt of the thermoplastic resin extruded from the capillary tubes thereby forming fine fibers.

In general, a melt blow die has to be designed such that the size of the orifices is uniform along the array or arrays of the capillary tubes so that a uniform distribution of the gas flow rate is obtained along the array or arrays of the orifice. This is because any irregularity in the drawing gas flow rate results in non-uniform quality of the product fibers.

Therefore, the first-mentioned type of melt blow die disclosed in Japanese Patent Publication No. 44470/1093 essentially requires that the gas plates and the die tip are extremely precisely finished and assembled in order to attain the desired uniformity of the gas orifice size. In addition, the size of the gas orifice tends to become non-uniform as a result of thermal strain or secular change during long use, even if the assembly of the die has been initially completed such as to provide a uniform size of the gas orifice. The second-mentioned type of the melt blow die having cantilevered capillary tubes suffer from disadvantages in that the free ends of the cantilevered capillary tubes tends to be irregularly positioned and to vibrate when blown by the drawing gas.

In order to attain uniform size of gas orifices in the melt blow die proposed in Japanese Patent Laid-Open Publication No. 159336/1981, it is necessary that the screen mesh be finished in such a way as to have tiny holes arranged at an extremely precise pitch. It is not easy to form such a screen mesh. In addition, it is necessary that the capillary tubes are inserted one by one into the designated tiny holes of the screen mesh, in order to correctly locate the capillary tubes so as to attain uniform size of the gas orifices. Such a work is extremely laborious.

For these reasons, it has been difficult to disassemble and reassemble a melt blow die for the purpose of inspection.

Accordingly, a first object of the present invention is to provide a melt blow die which can easily be disassembled and re-assembled and which have high degree of uniformity of the size of gas orifices around the capillary tubes.

The melt blow die of the type proposed in Japanese patent Publication No. 44470/1983 encounters another problem in that it requires laborious work for detaching and attaching the capillary tubes when cleaning or renewal of the capillary tube is required, because the capillary tubes are directly fixed to the die block by soldering. This problem is serious particularly in the case where a plurality of arrays of the capillary tubes are arranged densely. Namely, in such a case, a plurality of arrays of capillary tubes are soldered successively so that the heat applied during soldering of an array is transferred to the preceding array which has been soldered, due to small pitch of arrays and due to high heat conductivity of the die block which is usually made from a metal. In consequence, the solder of the preceding array is molten again to allow the capillary tubes of this array to be set irregularly.

It would be possible to solder a plurality of arrays of capillary tubes at once. However, it is quite difficult to solder a plurality of arrays of capillary tubes in one time without impairing regularity of arrangement of the capillary tubes.

Accordingly, a second object of the present invention is to provide a melt blow die which is improved in such a way as to facilitate replacement of the capillary tubes and to enable a plurality of arrays of capillary tubes at a small pitch.

SUMMARY OF THE INVENTION

To these ends, according to the present invention, there is provided a melt blow die comprising: a die block assembly having a chamber for receiving melt of a thermoplastic resin; at least one array of a plurality of capillary tubes arranged in a plane and having one ends held by the die block assembly, the capillary tube communicating with the chamber in the die block assembly; and gas plates connected to the die block assembly and defining therebetween gas chambers, the gas plates having lips which cooperate with each other to define a slit communicating with the gas chambers and to clamp the other ends of the array of capillary tubes in such a manner that gas orifices are formed between the peripheral surfaces of the capillary tubes and the adjacent surfaces of the lips, whereby a gas introduced into the gas chambers is blown through the gas orifices to draw the melt of the thermoplastic resin extruded through the capillary tubes.

In a preferred form of the invention, the array of the capillary tubes are beforehand integrated so as to form a capillary tube unit which is detachably secured between a pair of die blocks.

DESCRIPTION OF THE PREFERRED EMBODIMENTS

Figure 1:
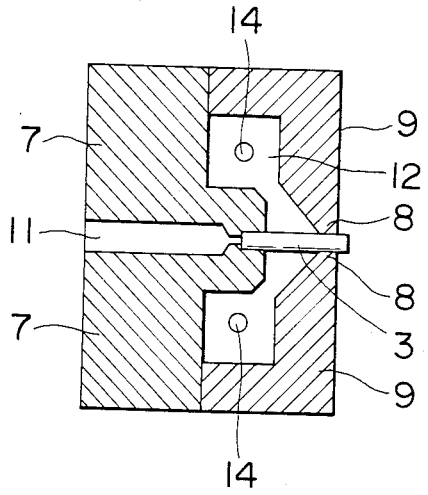
FIG. 1 is a longitudinal sectional view of an embodiment of a melt blow die in accordance with the present invention.

The most critical feature of the melt blow die in accordance with the present invention resides in that the ends of capillary tubes confronting a gas orifice is clamped between lips of gas plates which define the gas orifice. The lips of the gas plates press the capillary tubes in such a neat manner as to absorb any dimensional error which may have been involved in the course of machining or assembly, while suppressing undesirable vibration of the capillary tubes. It is therefore possible to mechanically control the size of the gas orifices so as to prevent any fluctuation in the orifice size. In consequence, disassembly and reassembly of the melt blow die for the purpose of inspection can be conducted without impairing precision of essential portions of the melt blow die.

Another critical feature resides in that a plurality of capillary tubes are beforehand assembled together in the form of a unit or units. This not only enables any machining or assembly error to be absorbed but also facilitates inspection and replacement of the capillary tubes. The unit-type construction having a plurality of capillary tubes also facilitates assembly of a plurality of arrays because, in contrast to the conventional assembly method relying upon soldering, it is not necessary to take into account influence of heat. In consequence, a plurality of arrays of the capillary tubes can be arranged at a high density.

In general, capillary tubes used in the melt blow die of the present invention have inside diameters ranging between 0.1 to 1.0 mm and outside diameters ranging between 0.2 and 2 mm.

The end of the capillary tubes may project beyond the edges of the lips of the gas plates or may be retracted from the edges of the lips in amount which is typically 0.2 mm or greater.

Preferably, the the pressing surface of the lip of each gas plate has a width which is not smaller than 1 mm.

The melt blow die in accordance with the invention can have only one array of capillary tubes or two or more arrays may be integrated so as to provide a die having a plurality of arrays of capillary tubes.

The term "die block assembly" in this specification is used to mean an assembly capable of clamping a capillary tube unit so as to complete the die and including die blocks, block members, block pieces and so forth which also will be mentioned later.

The capillary tube unit can be formed by various methods. In a typical method, a reinforcer such as a metal sheet, tube or a rod is placed in contact with an array of capillary tubes preferably at each side of the array, such that the reinforcer extends in a direction which crosses the longitudinal axes of the capillary tubes, and then a brazing is effected to integrate the capillary tubes with the reinforcer by a brazing material such as silver. In another method, a sheet of a material which does not exhibit any wetness with respect to brazing material, e.g., ceramics, is placed preferably on each side of the array of the capillary tubes and the brazing material is poured into small gaps between the sheets and the capillary tubes, the sheets being then removed after solidification of the brazing material.

The thus formed capillary tube unit can be secured to the die block by means of, for example, screws. In such a case, side plates are placed on both sides of the array of capillary tubes and are fastened to the die block by means of screws.

The melt blowing is conducted by blowing a hot gas to the melt of a thermoplastic resin so as to draw and refine the streams of the melt into fine fibers. The thermoplastic resin used may contain a suitable dyestuff, additive and/or a denaturant as desired.

Figure 3:
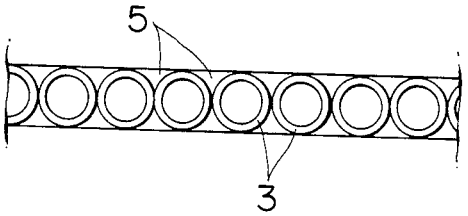
FIG. 3 is an enlarged view of an essential portion of the melt blow die as shown in FIG. 2.
Figure 4:
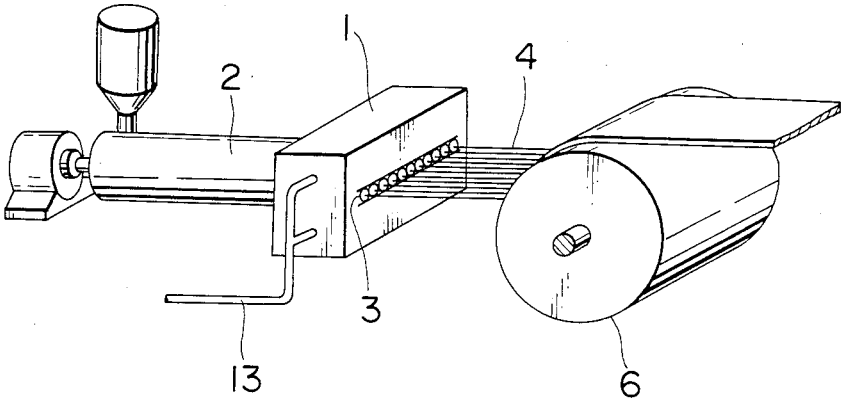
FIG. 4 is a perspective view of a melt spinning apparatus incorporating a melt blow die in accordance with the present invention.

FIG. 4 shows a melt spinning apparatus which employs a first embodiment of the melt blow die in accordance with the present invention. The melt spinning apparatus has an extruder for melting and kneading a thermoplastic resin and extruding the kneaded resin through capillary tubes 3 on the melt blow die 1. Streams or fibers 4 of the melt immediately after the extrusion are drawn by a gas which is blown through gas orifices 5 (see FIG. 3) so as to become fibers which are then taken up by a collecting device 6.

Figure 2:
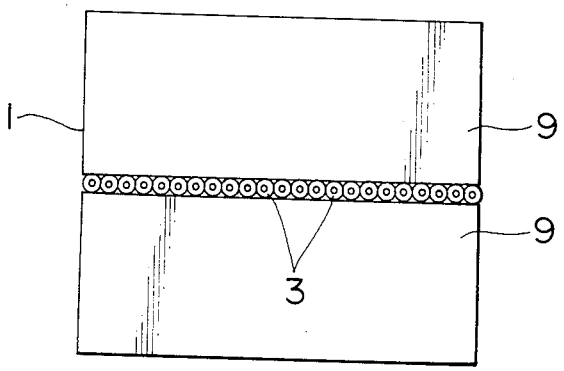
FIG. 2 is a side elevational view of the melt blow die as shown in FIG. 1.

As shown in FIGS. 1 to 3, the first embodiment of the melt blow die of the present invention has a plurality of capillary tubes 3 arranged in a common plane and in contact with adjacent ones so as to form an array. The arrayed capillary tubes are clamped at their one ends between a pair of die blocks 7,7 and at their other ends between lips 8,8 of a pair of gas plates 9, 9.

The die blocks 7,7 also define a chamber 11 communicating with capillary tubes 3. Melt of a thermoplastic resin supplied into this chamber 11 is forced into the capillary tubes 3 so as to be extruded through the capillary tubes 3. Each gas plate 9 cooperate with corresponding die block 7 in defining therebetween a gas chamber 12. A gas pipe 13 is branched into two pipes which are connected to gas inlet ports 14 opening into the respective gas chambers 12. As shown in FIGS. 2 and 3, the surfaces of the lips 8,8 of the gas plates 9,9 contacting the capillary tubes 3 are flat so that a multiplicity of gas orifices are formed between the capillary tubes 3 and the surfaces of the lips 8,8. The gas introduced into the gas chambers 12 is jetted through these gas orifices 5. The capillary tubes 3 are positioned such that they slightly project from the ends of the lips 8,8 in a suitable amount, as will be seen from FIG. 1.

Figure 5:
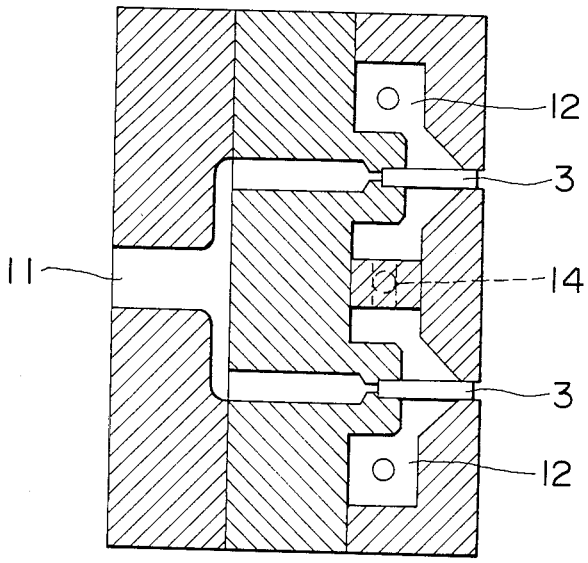
FIG. 5. is a vertical section of a further embodiment of the melt blow die of the present invention.

Although the embodiment shown in FIGS. 1 to 3 employs only one array of capillary tubes, this is not exclusive and the melt blow die of the present invention can have a plurality of arrays of capillary tubes. FIG. 5 shows an example of the melt blow die having a pair of arrays of capillary tubes. This melt blow die has a construction which is substantially equivalent to a combination of the melt blow die 1 shown in FIG. 1 placed one on the other. Thus, the melt blow die shown in FIG. 5 has a pair of gas chambers 12 communicating with a single gas inlet port 14. The chamber 11 is branched into two channels which communicate with respective arrays of the capillary tubes 3.

It will be understood that, in the described embodiment of the die, the capillary tubes 3 of the same diameter are clamped between flat surfaces of the lips 8,8 of the gas plates 9,9, so that the gas orifices 5 formed between the outer peripheral surfaces of the capillary tubes and the flat pressing surfaces of the lips have an equal size. It is thus possible to obtain a melt blow die with gas orifices of a uniform size, simply by clamping the ends of the capillary tubes by the lips of the gas plates. Any unevenness of the pressing surfaces of the lips, attributable to a machining error, thermal distortion or secular change, does not substantially affect the uniformity of the orifice size, because the orifice size does not fluctuate substantially insofar as the pressing surface contacts the capillary tubes. In addition, problems encountered by the known melt blow dies such as vibration of the capillary tubes and/or irregularity of the free ends of the capillary tubes can be overcome because the ends of the capillary tubes are held rigidly by the lips of the gas plates. For the same reason, the reassembly after disassembly for inspection can be conducted without impairing dimensional precision, so that the inspection of the die is facilitated advantageously.

Still another embodiment of the melt blow die in accordance with the present invention will be described hereinunder with reference to FIGS. 6 and 7.

Figure 6:
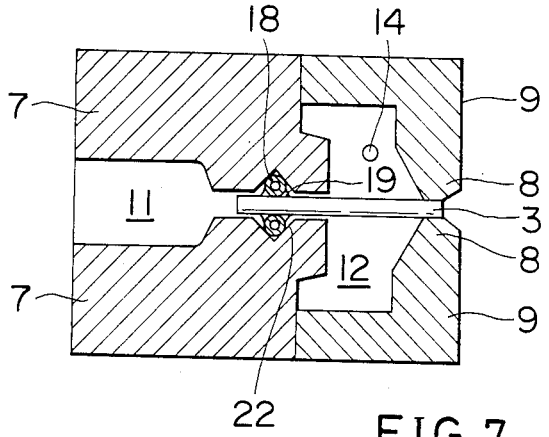
FIG. 6 is a vertical sectional view of another embodiment of the melt blow die of the present invention.
Figure 7:
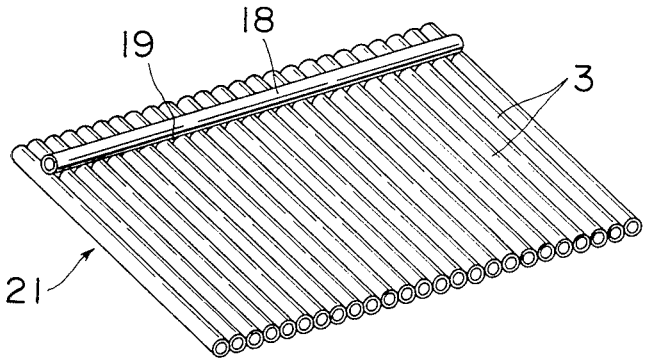
FIG. 7 is a perspective view of an example of a unit of capillary tubes incorporated in the melt blow die as shown in FIG. 6.

The melt blow die shown in FIG. 6 employs a capillary tube unit 21 which has, as shown in FIG. 7, an array of a plurality of capillary tubes 3 clamped at their one ends by a pair of pipes 18 as reinforcers and soldered thereto by means of a silver brazing material 19. The die also has a pair of die blocks 7,7 having V-shaped grooves 22 in their abutting surfaces. When assembled, the die blocks 7,7 securely hold one ends of the capillary tube unit 21, with their V-shaped grooves 22 receiving the pipes 18 on both sides of the capillary tube unit 21. The melt blow die further has a pair of gas plates 9,9 secured to the respective die blocks 7,7 and having lips 8,8 which cooperate with each other in clamping therebetween the ends of the capillary tubes 3 of the capillary tube unit 21 projecting from the die blocks 7,7.

The die blocks 7,7 when brought together define therebetween a chamber 11 which communicates with the capillary tubes 3 of the capillary tube unit 21. Melt of a thermoplastic resin supplied into the chamber 11 is forced into the capillary tubes 3 so as to be extruded from these capillary tubes 3. The pipes 18 pressed in the V-shaped grooves 22 provide a tight seal which prevent the internal resin from leaking outside. The gas plates 9 cooperate with the corresponding die blocks 7 in defining gas chambers 12. A gas pipe 13 is branched into two pipes which are connected to gas inlet ports 14 opening into the respective gas chambers 12 so as to supply the gas into the gas chambers 12. The pressing surfaces of the lips 8,8 contacting the capillary tubes 3 of the capillary tube unit 21 are flattened so that a plurality of gas orifices 5 are formed between the outer peripheral surfaces of the capillary tubes 3 and the adjacent flat surfaces of the lips 8,8. The gas supplied into the gas chambers 12 is jetted from these gas orifices 5.

Figure 9:
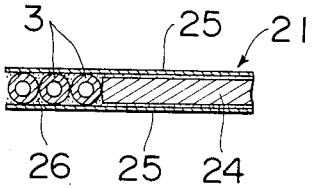
FIG. 9 is an enlarged side elevational view of a portion of the capillary tube unit as shown in FIG. 8.
Figure 8:
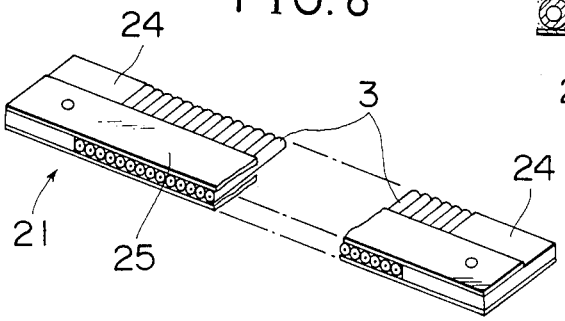
FIG. 8 is a perspective view of another example of the capillary tube unit.

FIGS. 8 and 9 show another example of the capilary tube unit 21. In this example, a pair of side plates 24 are placed on both ends of an array of capillary tubes 3, and a pair of reinforcer plates 25 are placed on both sides of the side plates 24 and one ends of the reinforcer plates 25. A silver brazing material in molten state is poured into tiny cavities between the outer peripheral surfaces of the capillary tubes and the surfaces of the adjacent side plates 24 and the reinforcer plates 25, whereby the capillary tubes 3, reinforcer plates 25 and the side plates 24 are integrated by brazing.

Figure 10:
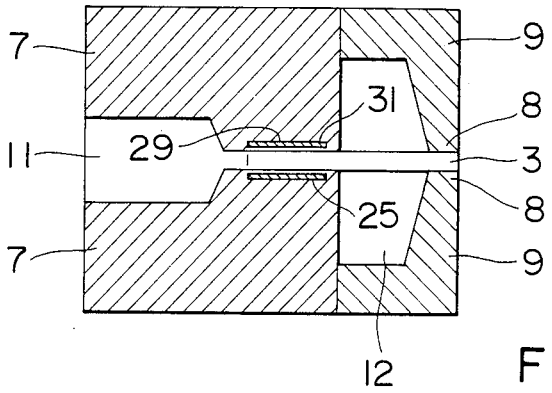
FIG. 10 is a sectional view of a melt blow die incorporating a unit as shown in FIG. 8.

FIG. 10 shows a melt blow die which incorporates the capillary tube unit 21 as shown in FIG. 8. The die blocks 7,7 are provided in their abutting surfaces with flat recesses 29 adapted for receiving the reinforcer plates 25 when the die blocks 7,7 are brought together An elastic and heat-resistant packing seat 31 is placed between each reinforcer plate 25 and the bottom of the flat recess 29, in order to provide a seat which effectively presents the internal resin form leaking outside. The capillary tube unit 21 is fastened to either one of the die blocks 7,7 by means of screws which are screwed into threaded holes in the die block through apertures formed in the side plates 24.

Although the melt blow dies shown in FIGS. 6 and 10 employ only one capillary tube unit, they are only illustrative and the melt blow die of the present invention can employ two or more capillary tube units.

Figure 11:
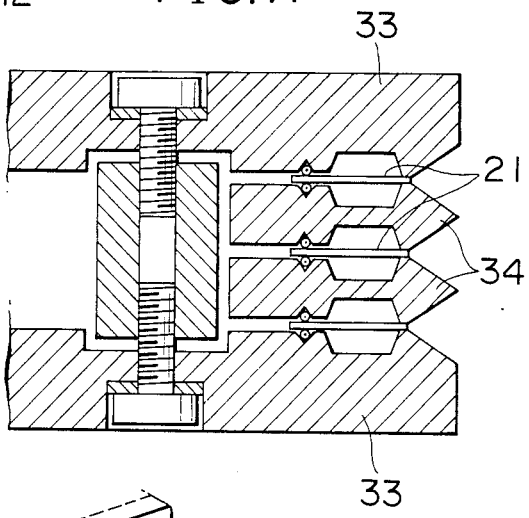
FIG. 11 is a sectional view of still another embodiment.

FIG. 11 shows an embodiment which employs a plurality of capillary tube units arranged one on another. More specifically, this embodiment has a pair of die block bodies 33 which are arranged to oppose each other and a plurality of die block pieces 34 having surfaces symmetrical with the inner surfaces of the die block members 33, 33 and disposed between the opposing surfaces of the die block members 33, 33. The capillary tube unit 21 as shown in FIG. 7 are placed between the inner surfaces of the die block members 33, 33 and the adjacent die block pieces 34,34 and between the opposing surfaces of adjacent die block pieces 34.

Figure 12:
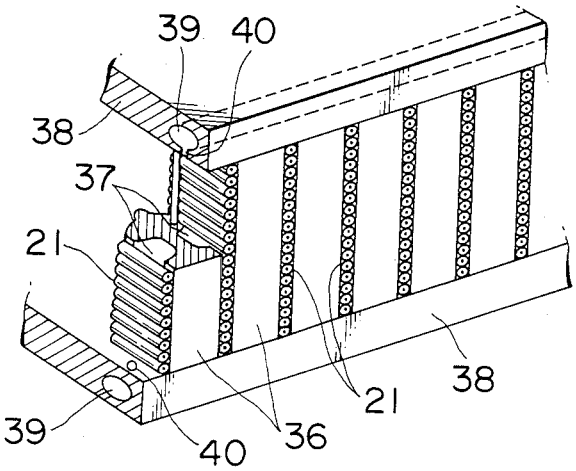
FIG. 12 is a perspective view of an essential portion of a further embodiment.

FIG. 12 shows an embodiment in which a multiplicity of capillary tube units 21 are arranged in horizontal direction. This embodiment of the melt blow die of the invention has a plurality of block pieces 36 each having symmetrical recesses 37 for forming the gas chambers, as well as symmetrical V-shaped grooves for receiving the pipes of the respective capillary tube units. Capillary tube unis 21 of the same type as that shown in FIG. 7 are secured to both sides of each block piece 36 such that the array of the capillary tube of each unit extends vertically. Thus, each capillary tube unit 21 is clamped between each pair of adjacent block pieces 36. The thus formed assembly constituted by the alternating lateral arrangement of the capillary tube units 21 and the block pieces 36 is clamped at its upper and lower ends between a pair of die block members 38, 38 which constitutes the die block together with the die block pieces 36. Each die block member 38 has a laterally extending gas passage 39 formed therein and communicating with the gas chambers formed by the recesses 37 through respective conduits 40.

Thus, in the embodiments of the invention shown in FIGS. 6 to 12, a plurality of arrayed capillary tubes are constructed beforehand as an integral capillary tube unit by brazing or soldering. The capillary tube unit thus formed is fixed to the die block mechanically by clamping or by means of screws, through the intermediary of reinforcers or similar members. In contrast to the known melt blow dies in which the capillary tubes are directly fixed to the die block, the melt blow die in accordance with the present invention enables the capillary tubes to be easily demounted and remounted for the purpose of inspection, cleaning or renewal. In addition, the unit-type construction of the capillary tube array appreciably reduces the production cost of the melt blow die and can be wasted as desired. Furthermore, when the melt blow die is required to have a plurality of arrays of capillary tubes, the pitch of the arrays can be reduced so as to increase the number of spinning nozzles per unit area of the blow melt die. Consequently, it becomes possible to obtain a melt blow die having a compact design and capable of operating with reduced input energy.

What is claimed is:

1. A melt blow die comprising:

a die block assembly having a chamber for receiving melt of a thermoplastic resin;

at least one array of a plurality of capillary tubes, said capillary tubes of said at least one array each having an axis, a first end, a second end and a peripheral surface, said capillary tubes of said at least one array arranged in a plane with their axes substantially parallel to one another, each of said capillary tubes of said at least one array having a portion of its peripheral surface in contact with adjacent capillary tubes, each of said capillary tubes of said array having said first end held by said die block assembly, each of said capillary tubes of said array communicating with said chamber in said die block assembly; and gas plates connected to said die block assembly and defining therebetween gas chambers, said gas plates having lips which have respective contact surfaces and outer edges, said lips cooperating with each other to define a slit communicating with said gas chambers and to clamp said second ends of said capillary tubes of said array between said contact surfaces in such a manner that gas orifices are formed between said peripheral surfaces of said capillary tubes and adjacent contact surfaces of said lips, whereby a gas introduced into said gas chambers is blown through said gas orifices to draw said melt of said thermoplastic resin extruded through said capillary tubes.

2. A melt blow die according to claim 1, wherein said second ends of said capillary tubes are projected beyond the outer edges of said lips.

3. A melt blow die according to claim 1, wherein said second ends of said capillary tubes are retracted from the outer edges of said lips.

4. A melt blow die according to claim 1, comprising a plurality of said arrays of capillary tubes.

5. A melt blow die having at least one array of a plurality of capillary tubes and gas orifices arranged around said capillary tubes so that streams of melt of a thermoplastic resin immediately after extrusion from said capillary tubes are drawn into fine fibers by a gas blown through said gas orifices, said melt blow die comprising:

at least one capillary tube unit composed of an integral array of a plurality of capillary tubes, each of said capillary tubes having a first end, a second end and a peripheral surface, and detachably, mechanically secured between a pair of die blocks; and gas plates projected from said die blocks and having lips with flat surfaces which cooperate with each other in clamping therebetween said second ends of said capillary tubes of said capillary tube unit while said first ends of said capillary tubes are fixed between said die blocks, said gas plates and said die blocks cooperating in defining therebetween gas chambers communicating with said gas orifices, said gas orifices formed by said flat surfaces of said lips and said peripheral surfaces of said capillary tubes clamped between said flat surfaces.

6. A melt blow die according to claim 5, wherein said capillary tube unit is composed of an array of a plurality of capillary tubes which are integrated by brazing or soldering and at least one substantially rod-like reinforcer attached to said first ends of said capillary tubes.

7. A melt blow die according to claim 5, wherein said capillary tube unit is composed of an array of a plurality of capillary tubes which are integrated through a pair of plates attached to said capillary tubes at opposite sides of said array proximate said first ends of said capillary tubes.

8. A melt blow die according to claim 5, comprising a plurality of said capillary tube units.

* * * * *